US005639976A

United States Patent [19]

Manoff et al.

[11] Patent Number: 5,639,976

[45] Date of Patent: Jun. 17, 1997

[54] CYMBAL FOR PERCUSSION MUSICAL INSTRUMENTS

[76] Inventors: Hector Ariel Manoff; Gaston Costa Sanjurjo, both of Lavalle 1474 2° C, (1048) - Buenos Aires, Argentina

[21] Appl. No.: 544,999

[22] Filed: Oct. 30, 1995

[30] Foreign Application Priority Data

Jun. 23, 1995 [AR] Argentina ..... 332.547

[51] Int. Cl.[6] ..... G10D 13/06

[52] U.S. Cl. ..... 84/402

[58] Field of Search ..... 84/402, 422.3

[56] References Cited

U.S. PATENT DOCUMENTS 3,546,994 12/1970 Paiste ..... 84/402

4,809,581 3/1989 Paiste, Sr. et al. ..... 84/402

*Primary Examiner*—Patrick J. Stanzione

[57] ABSTRACT

A new metal cymbal for percussion musical instruments, that combines the sound effects of the metal with the effects generated by a liquid, comprising a metal plate having at least one leakproof or watertight chamber containing a liquid.

9 Claims, 1 Drawing Sheet

CYMBAL FOR PERCUSSION MUSICAL INSTRUMENTS

BACKGROUND OF THE INVENTION

1. Field of the Invention

The present invention relates to percussion musical instruments, such as for the percussion section of an orchestra or band, and particularly refers to a cymbal capable of being used alone or in pairs.

For the purpose of this specification the cymbal is understood as being a concave metal plate, generally brass-made and large concave, preferably used to accompany the bass drum either in pairs rubbed or struck together or suspended or mounted singly and struck by drumsticks.

2. Description of the Prior Art

Cymbals are well known in the musical field and generally comprise concave brass plates having a dome central portion. In the case of cymbals used in pairs to be struck together, a rigid handle or a strap is fixed close to the dome portion so that each cymbal can be firmly taken by a hand. In a cymbal used suspended to accompany the drums of a battery and to be struck by the drumsticks, the dome has an orifice to be connected to a stand or support.

As far as the inventor knows no improvements have been made to the above basic design of a classic cymbal, with the structure thereof remaining the same for years. Some improvements however have been made in the metal plate to obtain particular sounds and brilliant tones. Thus, textured surfaces have been created, the thickness of the plate as well as the shapes and sizes have been varied, and many metal alloys have been used such as brass, copper, tin, phosphorus, etc. in several combined percentages.

Although the above changes in the basic design have achieved new acoustical effects, brilliant sounds and tones, there have been no changes involving the use of a medium different from the metal of the plate that combined with the metal, but forming no part thereof, results in new sound and acoustical effects never heard till now.

3. Summary of the Invention

Upon the lack of changes and new designs in cymbals as remarked above, it is an object of the present invention to provide a new cymbal that combines the sound effects of the metal generally used for this instrument with the effects generated by a medium, such as a gas and/or a liquid.

It is a further object of the invention to provide a cymbal for percussion musical instruments comprising a metal plate having at least one leakproof or watertight chamber containing a medium having a density differing from the density of the plate metal and from an environmental medium of the cymbal.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
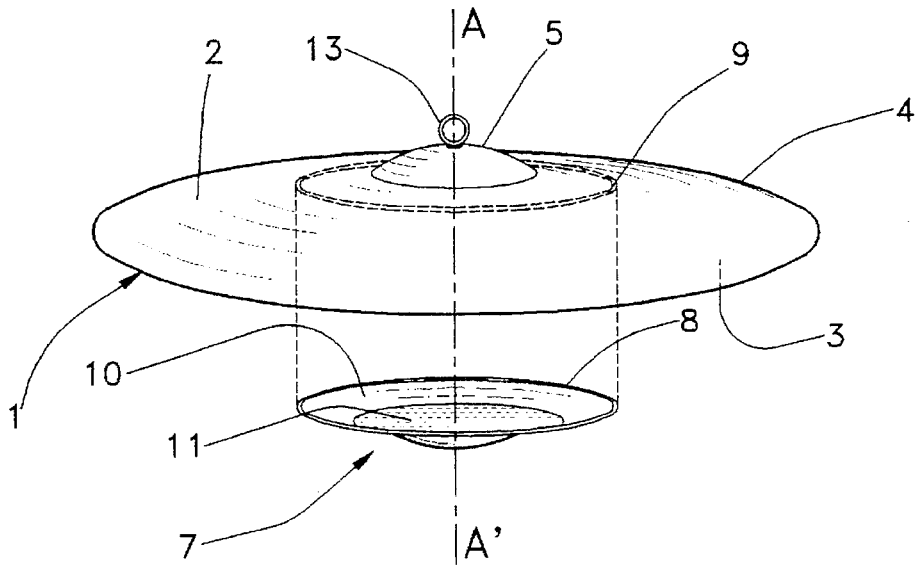
FIG. 1 is an exploded top perspective view of a cymbal according to a first embodiment of the invention.
Figure 2:
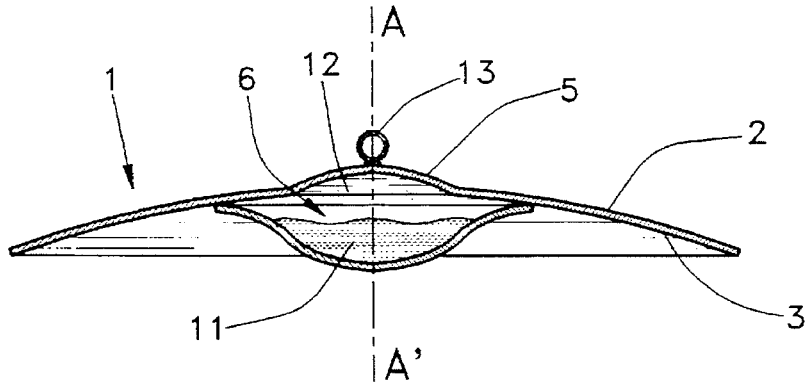
FIG. 2 is a cross section view of the cymbal of FIG. 1.

Referring now in detail to the drawings. FIGS. 1 and 2 show a cymbal according to a first embodiment of the invention, the cymbal comprising a metal plate 1 having a convex outer face 2 and a concave inner face 3, a peripheral edge 4 and a central dome portion 5. The plate comprises a chamber 6 formed by a dish-like metal member 7 having a peripheral edge 8 to be joined to inner face 3 along a circular line 9, by welding, for example. Member 7 defines a cavity 10 containing a medium 11 selected from any gas and liquid, such as oil, alcohol, water, mercury and mixtures thereof. In the embodiment shown in FIGS. 1 and 2 chamber 6 contains a liquid and air 12. In the event the cymbal is to be used suspended from a stand or support, suspending means such as a ring 13 is provided in the center axis A–A' of dome 5, for allowing an oscillating movement of the cymbal when struck by the drumsticks. If the cymbal is to be used in pairs to be struck together, a handle, not shown, may be provided.

Liquid 11 will move freely within chamber 6 and is capable of interacting with the vibrations of the cymbal when struck. The provision of one or more chambers housing liquids in contact with the vibrating surface of the cymbal produces changes in the frequency and dampering of one or several of the vibration eigentones. Generally, the normal frequencies ratios between these tones also vary. This effect varies on the number, size and geometrical arrangement of the chambers, the size ratio between the plate and the respective chamber as well as the density, viscosity and quantity of liquid contained into the chamber.

Upon variation of the mass distribution of liquid within the chamber or chambers due to the strikes on the cymbal, the frequency and dampering of some eigentones change continuously, generating a complex behavior of the cymbal that can be controlled by the player. The acoustic wave generated by the above vibratory behavior has several resonance frequencies moving towards the high and lower frequencies zones in a continuous or oscillating manner, as well as in a combination of both modes.

Figure 3:
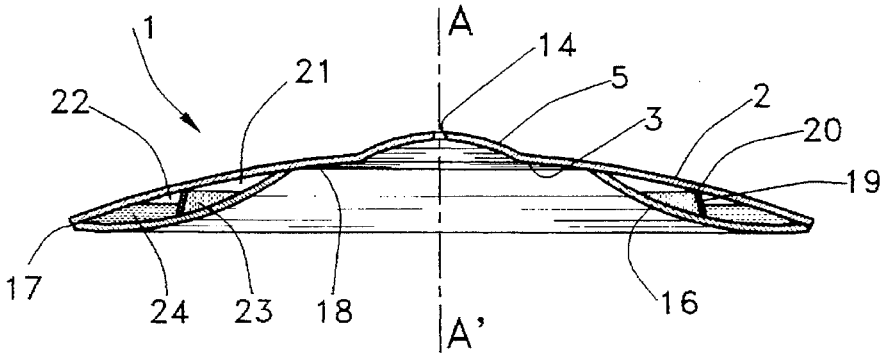
FIG. 3 is a cross section view of a cymbal according to a second embodiment of the invention.

A second embodiment of the invention is shown in FIG. 3, by means of which embodiments the same above sound effects and other more complex combinations may be obtained thank to the provision of more than one liquid. The same components of the basic plate 1 appearing in this embodiment and in that one shown in FIGS. 1 and 2 are indicated by the same number references.

Plate 1 includes a ring-shaped metal member 16 having an outer peripheral edge 17 and an inner peripheral edge 18, the outer edge 17 being fixed coincident with peripheral edge 4 of plate 1 and inner edge 18 being fixed against inner concave face 3 between dome 5 and edge 4. In a preferred manner, edges 17, 18 are welded to the concave face of the plate, concentrically with the dome portion. Since the dome is free of obstruction from a chamber, dome 5 may include a conventional orifice 14 so that the cymbal may be suspended from a stand or support not shown.

Member 16 has a generally concave shape with an inner wall 19 located into a concave side of the ring member and extending inwardly radially to define an outer edge 20 to be fixed also to inner face 3. Wall 19 may also outwardly extended and edge 20 may include a seal (not shown) so as to close against face 3 without welding being necessary. Ring member 16 defines with plate 1 a pair of annular and concentric chambers 21, 22 containing different liquids 23, 24.

Chamber 22, 23 of FIG. 3 as well as chamber 6 of FIGS. 1 and 2 may be partially or completely occupied by liquid.

While preferred embodiments of the present invention have been illustrated and described, it will be obvious to those skilled in the art that various changes and modifications may be made therein without departing from the scope of the invention as defined in the appended claims.

We claim:

1. A cymbal for percussion musical instruments comprising a metal plate having at least one watertight chamber containing a medium having a density differing from the density of the plate metal and from an environmental medium of the cymbal.

2. A cymbal according to claim 1, wherein the plate defines a central dome portion, a circular peripheral edge, a convex face and a concave face.

3. A cymbal according to claim 2, wherein the at least one chamber is formed by a dish-like metal member welded to the concave face of the plate, concentrically to and encircling the dome portion.

4. A cymbal according to claim 3, wherein the medium located within the chamber is at least one of oil, water, alcohol, air, gas, mercury or a mixture thereof.

5. A cymbal according to claim 2, wherein the at least one chamber is formed by a ring-shaped metal member welded to the concave face of the plate, between the peripheral edge and the dome portion of the plate member, concentrically to the dome portion.

6. A cymbal according to claim 5, wherein the medium located within the chamber is at least one of oil, water, alcohol, air, gas, mercury or a mixture thereof.

7. A cymbal according to claim 5, wherein the at least one chamber comprises a plurality of concentric chambers, each chamber containing at least one of oil, water, alcohol, air, gas, mercury or a mixture thereof.

8. A cymbal according to claim 7, wherein each of the plurality of chambers contains a different medium.

9. A cymbal according to claim 1, wherein the central dome portion has suspending means for suspending the cymbal from a support.

* * * * *